US010947690B2

(12) United States Patent
Huston et al.

(10) Patent No.: US 10,947,690 B2
(45) Date of Patent: Mar. 16, 2021

(54) TRENCHLESS METHOD OF INSTALLING A MONOLITHIC MANHOLE IN A LEVEE FOR PIPE ACCESS

(71) Applicant: HYDRO-KLEAN, LLC, Des Moines, IA (US)

(72) Inventors: Matt Huston, Rhinelander, WI (US); Michael Ingham, Overland Park, KS (US)

(73) Assignee: Hydro-Klean, LLC, Des Moines, IA (US)

( * ) Notice: Subject to any disclaimer, the term of this patent is extended or adjusted under 35 U.S.C. 154(b) by 19 days.

(21) Appl. No.: 16/851,772

(22) Filed: Apr. 17, 2020

(65) Prior Publication Data

US 2020/0332488 A1 Oct. 22, 2020

Related U.S. Application Data

(60) Provisional application No. 62/835,567, filed on Apr. 18, 2019.

(51) Int. Cl.

| | |
|---|---|
| ***E02D 29/12*** | (2006.01) |
| ***E02D 15/04*** | (2006.01) |
| ***E02D 29/14*** | (2006.01) |
| *E02D 7/02* | (2006.01) |
| *E02B 3/10* | (2006.01) |

(52) U.S. Cl.

CPC ..... *E02D 15/04* (2013.01); *E02D 29/12* (2013.01); *E02D 29/14* (2013.01); *E02B 3/10* (2013.01); *E02D 7/02* (2013.01)

(58) Field of Classification Search

CPC ..... E02D 29/12; E02B 3/10

See application file for complete search history.

(56) References Cited

U.S. PATENT DOCUMENTS 3,621,623 A * 11/1971 Downes ..... E02D 29/124 404/25

4,127,990 A * 12/1978 Morrow ..... E02D 29/12 264/32

FOREIGN PATENT DOCUMENTS

| | | |
|---|---|---|
| JP | 8-333763 | * 12/1996 |
| JP | 2006-274655 | * 10/2006 |
| JP | 2012-237094 | * 12/2012 |

* cited by examiner

*Primary Examiner* — Sunil Singh

(74) *Attorney, Agent, or Firm* — McKee, Voorhees & Sease, PLC

(57) ABSTRACT

A monolithic manhole is formed in a levee without trenching, to provide access to drain pipes within the levee for maintenance and repair of the pipes. The manhole is formed by first forcing an outer tube downwardly into the earth and levee and removing soil from within the outer tube to expose the pipe. An inner tube is lowered into the outer tube, with an annular space maintained between the tubes. The annular space is filled with concrete, which hardens to form a monolithic vertical wall. A concrete floor may be poured at the bottom of the wall and a cover attached to the top of the wall. A hole is cut in the pipe inside the wall to provide internal access to the pipe.

20 Claims, 3 Drawing Sheets

TRENCHLESS METHOD OF INSTALLING A MONOLITHIC MANHOLE IN A LEVEE FOR PIPE ACCESS

CROSS-REFERENCE TO RELATED APPLICATIONS

This application claims priority to Provisional Application U.S. Ser. No. 62/835,567, filed on Apr. 18, 2019, which is herein incorporated by reference in its entirety.

FIELD OF INVENTION

The present invention is directed toward a method of forming a manhole in a levy, without trenching, to provide access to drain pipes in the levee, so the pipes can be maintained or repaired.

BACKGROUND OF THE INVENTION

Earthen levees are often built along rivers, and other bodies of water for flood control. Drain tile pipes are typically installed within a levee that run parallel with the levee along the body of water. For example, a perforated pipe installed within the body of the levee is designed to carry away water that has saturated the levee during various levels of river flood stage. The perforated pipe is connected to a transverse solid collector pipe, which in turn is connected to a pump for the purpose of pumping the collected water back to the river side of the levee. Often, there is no access to the drain tile pipes for maintenance and repair, thus requiring a trench to be dug into the levee for access to the pipes. However, the trench can compromise the integrity of the levee, and lead to potential failure of the levee and subsequent flooding.

Therefore, there is a need to provide access to drain pipes within a levee, without jeopardizing or damaging the integrity of the levee.

Accordingly, a primary objective of the present invention is the provision of a trenchless method of installing a manhole in a levee for drain pipe access.

Another objective of the present invention is the provision of a method of installing a manhole in a levee which preserves the strength and integrity of the levee.

Yet another objective of the present invention is the provision of a manhole levee which can be retrofit into an existing levee.

A further objective of the present invention is the provision of a method of constructing a levee manhole having any desired diameter and height.

Another objective of the present invention is the provision of a method of constructing a manhole in a levee for accessing a drain line without trenching into the levee.

Still another objective of the present invention is the provision of a method of installing a monolithic manhole in a levee which is economical and safe.

These and other objectives will become apparent from the following description of the invention.

SUMMARY OF THE INVENTION

A trenchless method of installing a monolithic manhole in the levee for pipe access is economical and safe. The method includes an initial step of pushing an outer tubular member downwardly into the earthen levee, preferably by vacuum excavation. After the outer tube reaches the depth of the pipe, a floor or base may be formed in the bottom of the outer tube, such as with poured concrete. After the floor is formed, an inner tubular member is lowered into the outer tubular member, with a gap or annular space between the outer and inner tubular members. The space is then filled with concrete, or other material, to form a monolithic manhole from the floor to the ground surface. Then, an upper portion of the exposed pipe within the manhole can be removed for internal access to the pipe. A sloped cap may also be poured on top of the floor to drain toward the pipe opening. A cover may be bolted or otherwise removably connected to the top of the manhole wall.

DETAILED DESCRIPTION OF THE INVENTION

Figure 1:
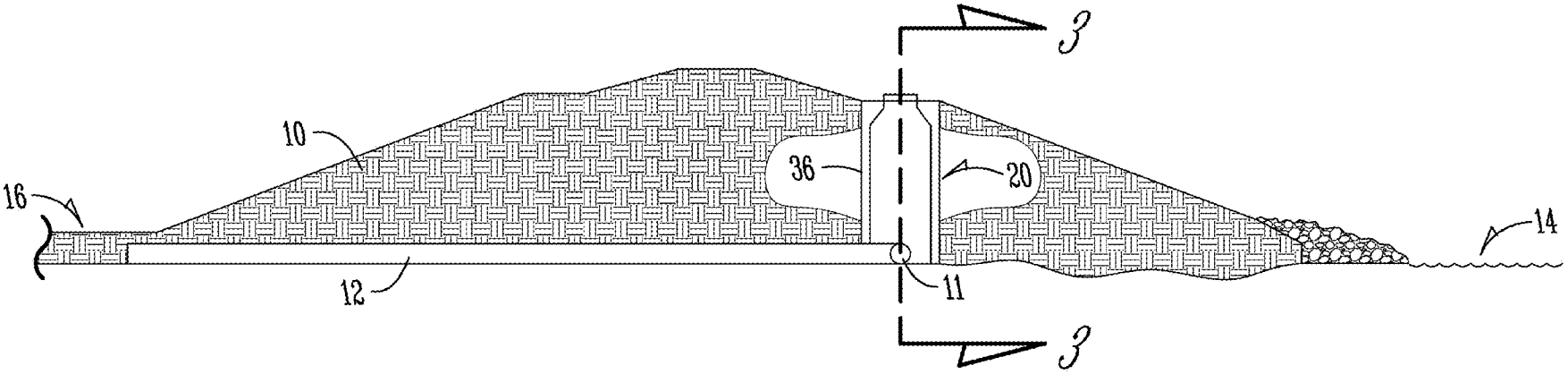
FIG. 1 is an elevation view of the levee with a drain pipe, a collection pipe, and a manhole formed in accordance with the present invention.
Figure 2:
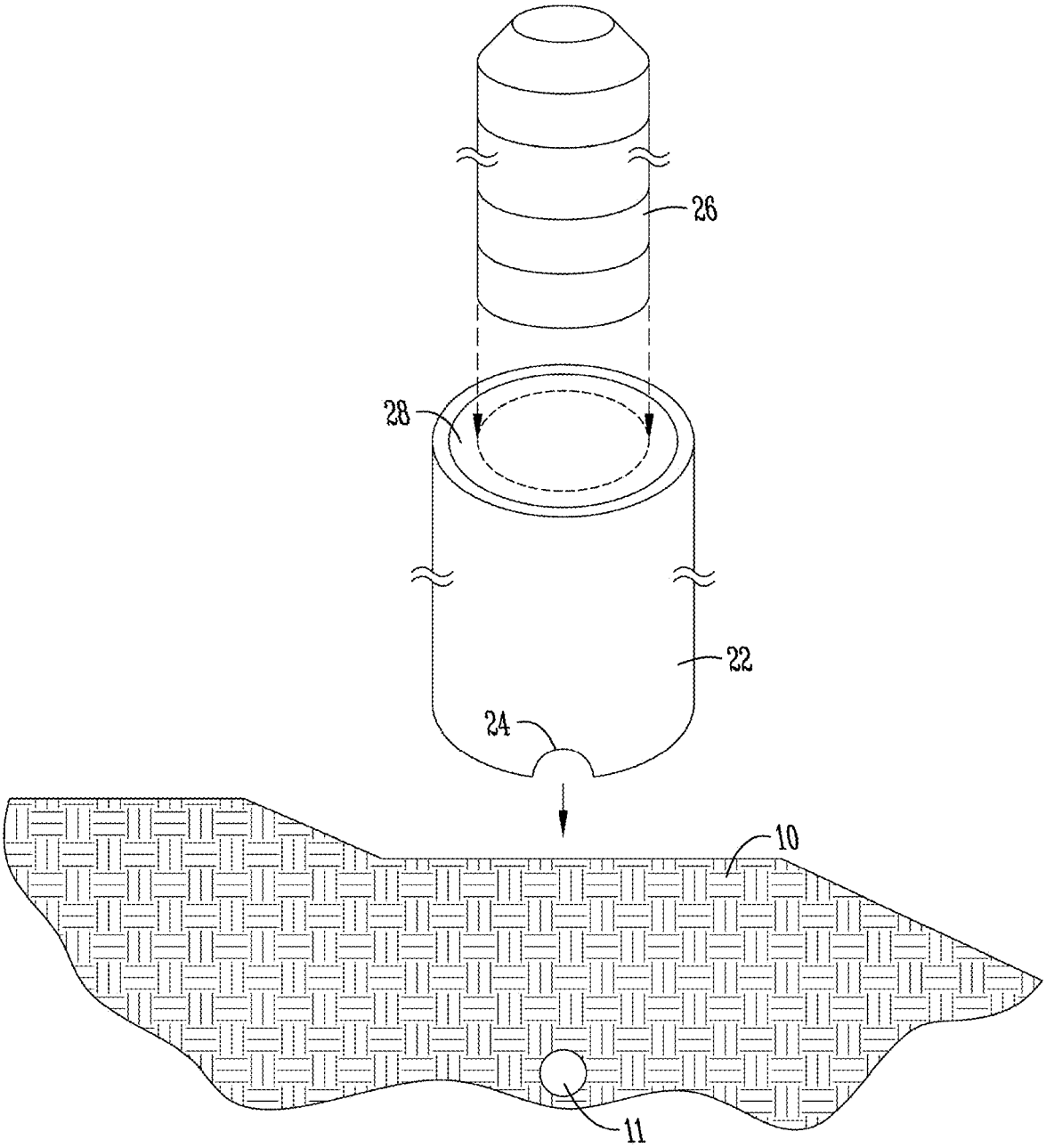
FIG. 2 is an exploded schematic of the components for forming the manhole in the levee.

FIG. 1 shows a levee 10 with at least one perforated drain tile pipe 11 running lengthwise along the levee, and at least one solid collector drain pipe 12, extending transverse to the levee from the drain tile pipe 11 to a pump station (not shown), at the base of the levee on the land side 16. The levee 10 is constructed adjacent a body of water 14 to protect the land 16 from flooding. The pump station is operatively connected to the collector pipe 12 to pump collected water back to the water side 14 of the levee 10. The levee 10 and drain pipes 11, 12 are conventional and may have a variety of constructions.

The method of installing the new, poured-in-place manhole 20 begins by determining the location that the manhole is to be installed in the levee 10 for intersecting with one or both of the drain pipes 11, 12. One option for selecting or determining the manhole location is to extend a camera with a transmitter, such as a Sonde transmitter, in one end of the pipe 11 or 12 or at a downstream access point. The camera is pushed upstream to view the pipe and to position a transmitter. An above-ground receiver senses a signal from the transmitter within the pipe. The camera is moved through the pipe to a position corresponding to the desired position for the manhole.

Once the new manhole position is set, a hollow tube 22 is forced downwardly from the upper surface of the levee 10 using a vacuum excavator. In one embodiment, the tube 22 is approximately 60 inches in diameter and made of any suitable material, such as fiberglass. The tube 22 may have other dimensions and may be made of different materials. The vacuum excavator removes the levee material or soil from the interior of the tube 22, thereby allowing the tube 22 to be lowered into the levee. The tube 22 is notched 24 at the lower end, which allows the tube 22 to be saddled over the pipe 11 or 12 until the tube is at the desired final elevation, with the bottom of the tube 22 being approximately 6 inches below the pipe. The tube 22 may be position over the perforated pipe 11 or the solid collector pipe 12, or at the T intersection of these pipes.

Next, concrete, such as ready-mixed concrete, is placed at the bottom of the fiberglass tube 22 and poured to a thickness of approximately 6 inches, or to the lowest pipe invert elevation, so as to form a base or foundation 25.

Figure 3:
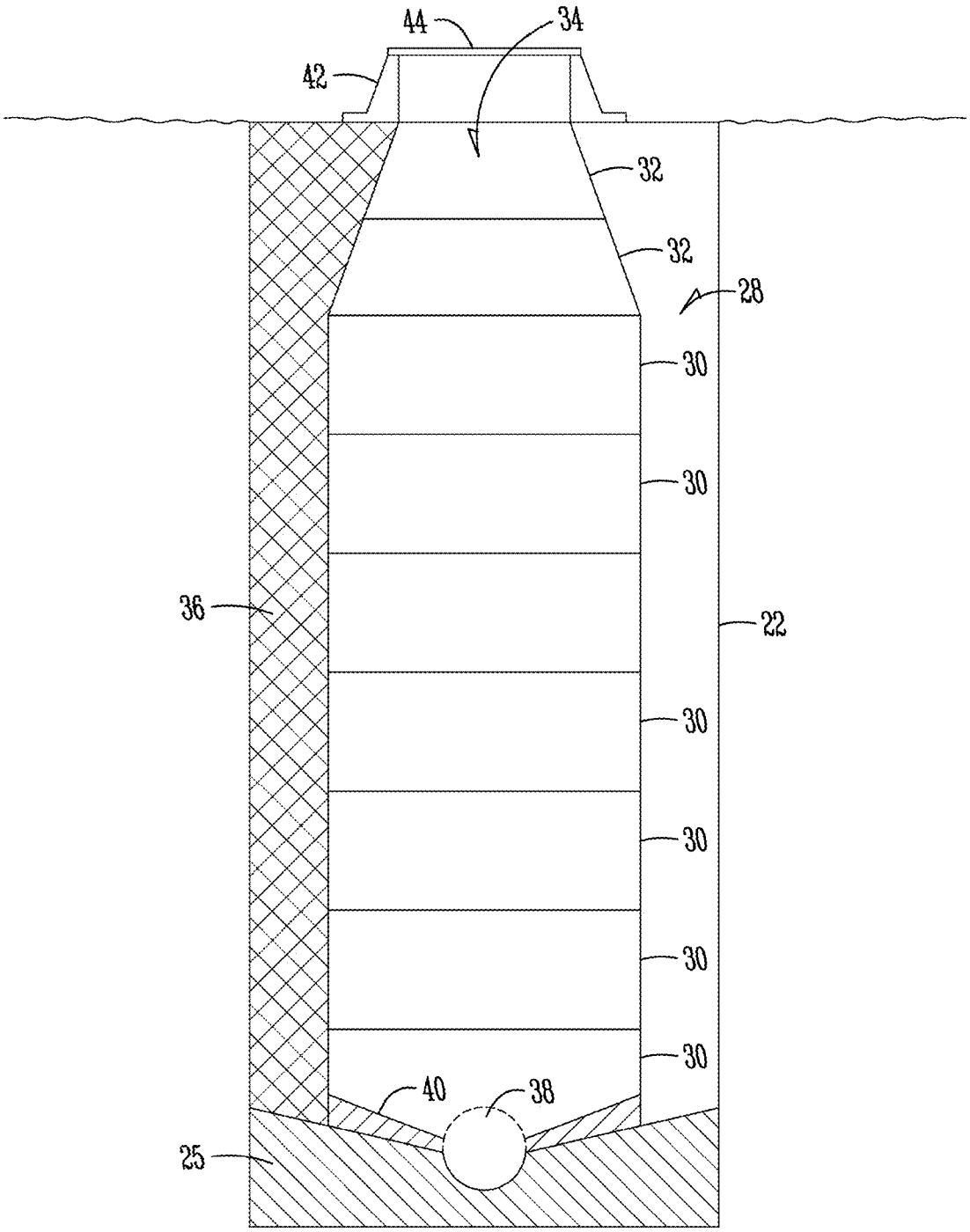
FIG. 3 is a sectional view of the monolithic manhole, taken along lines 3-3 of FIG. 1.

Preferably, the base 25 is sloped downwardly toward the pipe, as shown in FIG. 3, though the base may be horizontal. After the concrete has sufficiently cured, the pipe 11 and/or 12 is opened by cutting and removing the top half of the pipe inside the tube 22. The opening may extend the full diameter of the tube or may be a shorter segment of the pipe.

The soil surrounding the exterior of the tube 22 that has been disturbed during the vacuum excavation process may need stabilization. One method for stabilizing the soil is by injecting hydrophobic liquid polyurethane to fill voids and fissures. The stabilizing material may be injected through ports drilled through the tube 22 or through probes installed vertically around the exterior of the tube 22. The stabilization step creates a rigid and dense closed soil/grout matrix to solidify soils on the exterior of the manhole 20. Other soil stabilization methods may also be used.

A cylindrical manhole forming system 26 is lowered into the tube 22 so as to be concentric within the tube 22 and define an annular space 28 between the interior of the tube 22 and the exterior of the forming system 26. One example of a forming system is the Monoform by HydroKlean, LLC used for rehabilitating deteriorated manholes, such as old brick manholes. Preferably, the gap 28 between the tube 22 and the forming system 26 is approximately 10 inches but can vary in thickness based on factors such as buoyancy mitigation calculations. The forming system 26 may include multiple cylindrical sections 30 with various diameters and rise heights, with tapered reducing sections to connect the different diameter straight sections. For example, the initial base or bottom section may have a 40-inch diameter and is set level and plum on the base 25, which serves as the footing for the forming system 26. Preferably, both the drainage pipe 11 and the collector pipe 12 will be slipped or "blocked out", with inserts butted to the base and extending slightly into the pipe connections. The additional sections of the forming system 26 are then installed above the base 25, to the final elevation height of the manhole 20. The top of the forming structure 26 includes a conical section 32, which can reduce the diameter of the forming system to approximately 26 inches. The conical section 32 defines an access opening 34 at the top of the manhole 20. The opening 34 may be concentric or eccentric to the center axis of the manhole 20.

Concrete, such as ready-mixed concrete, or other material is then poured into the annular space 28 between the outer tube 22 and the inner forming tubes 26 so as to create the new monolithic concrete manhole wall 36. The final height or elevation of the wall 36 may be flush with the levee 10 or may extend above the levee. After the concrete has cured or obtained sufficient strength so as to avoid slumping, the forming system 26 is removed to expose the newly poured walls. The pipe slips or "block out" inserts (not shown) can also be removed from the pipe 11, 12 so that the upper cut out 38 is open.

A cap 40 may be formed in the bottom of the manhole, on top of the base 25, after the concrete wall 36 is poured. Preferably, the cap 40 has a 1 inch per foot slope from the spring-line of the exposed pipe 11, 12 and extending to the manhole wall. The cap provides a seal at the interface of the base 25 and the wall 36.

After the concrete wall 36 has cured, the top is provided with a frame 42 and a removable cover 44. The frame 42 may be set on a gasket and fastened or otherwise secured to the top of the wall with stainless steel anchor bolts. The cover 44 is preferably bolted to the frame 42, for example using stainless steel bolts, or may be pivotally connected to the frame for movement between open and closed positions.

After the manhole 20 is constructed, the site may be cleaned up by disposal of the levee soil and materials removed from inside the tube 22. The soil around the top of the manhole 20 can be finished to eliminate any remaining evidence of the construction process, such as mulching, seeding, or sodding.

The manhole installation method of the present invention eliminates trenching of the levee and produces a monolithic concrete wall without affecting the integrity of the levee 10. The manhole may be made to any desired height and diameter.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed:

1. A method of creating a manhole in a soil levee having a drain pipe, comprising:

determining a location of the manhole so as to intersect the drain pipe;

inserting an outer tube vertically into the levee by vacuum excavation, so as to remove soil from inside the outer tube;

inserting an inner tube inside the outer tube so as to provide an annular space between the tubes; and pouring concrete into the space to form a monolith concrete manhole wall.

2. The method of claim 1 further comprising removing the inner tube after the concrete has cured to a non-slump strength.

3. The method of claim 1 further comprising pouring a concrete base in the bottom of the outer tube before the inner tube is inserted.

4. The method of claim 3 further comprising forming a sloped cap on the base after the inner tube is inserted.

5. The method of claim 1 further comprising adding a stabilizer to the soil around the outer tube.

6. The method of claim 1 further comprising providing a cover on top of the manhole wall.

7. The method of claim 6, further comprising attaching a frame to a top of the manhole wall, with the cover being secured to the frame.

8. The method of claim 1 wherein the inner tube includes multiple cylindrical sections stacked one upon another.

9. The method of claim 8 wherein the sections have different diameters to create different diameters along the manhole wall.

10. The method of claim 1 wherein the manhole is formed without digging a trench in the levee.

11. A method of providing access to a pipe in an earthen levee, comprising:

forcing an outer tubular member downwardly into the levee until a bottom of the outer tubular member is at least level with the pipe; then removing soil within the outer tubular member; then lowering an inner tubular member into the outer tubular member so as to form an annular space between the outer and inner tubular members; then filling the annular space with material to form an annular wall; and removing an upper piece of the pipe within the annular wall to expose the interior of the pipe.

12. The method of claim 11 wherein the inner tubular member has multiple stacked sections.

13. The method of claim 11 further comprising removing the inner tubular member after the annular wall is solidified.

14. The method of claim 11 further comprising forming a floor inside the outer tubular member before the inner tubular member is lowered.

15. The method of claim 14 further comprising forming a cap on top of the floor sloping downwardly from the annular wall to the pipe.

16. The method of claim 11 further comprising adding soil stabilizer material around the outer tubular member.

17. The method of claim 11 further comprising providing a cover on top of the annular wall above the levee.

18. The method of claim 11 wherein the annular wall is formed without trenching into the levee.

19. The method of claim 11 wherein the soil is removed from inside the outer tubular member by vacuum excavating.

20. The method of claim 11 wherein the soil is removed as the outer tubular member is forced downwardly into the levee.

* * * * *